US005246507A

United States Patent [19]

Kodama et al.

[11] Patent Number: 5,246,507

[45] Date of Patent: Sep. 21, 1993

[54] METAL SURFACE TREATMENT AND AQUEOUS SOLUTION THEREFOR

[75] Inventors: Kenji Kodama; Yuzo Yamamoto, both of Wakayama, Japan

[73] Assignee: Kao Corporation, Tokyo, Japan

[21] Appl. No.: 819,183

[22] Filed: Jan. 10, 1992

Related U.S. Application Data

[62] Division of Ser. No. 569,921, Aug. 20, 1990, abandoned, which is a division of Ser. No. 285,858, Dec. 16, 1988, Pat. No. 4,978,399.

[30] Foreign Application Priority Data

Jan. 4, 1988 [JP] Japan ..... 63-196
Jan. 4, 1988 [JP] Japan ..... 63-197
Jan. 4, 1988 [JP] Japan ..... 63-198

[51] Int. Cl.[5] ..... C23C 22/68

[52] U.S. Cl. ..... 148/250; 106/14.15; 148/247; 148/251; 148/273; 524/247

[58] Field of Search ..... 148/247, 250, 251, 273; 524/247; 106/14.15

[56] References Cited

U.S. PATENT DOCUMENTS 4,457,790 7/1984 Lindert et al. ..... 106/14.15
4,795,506 1/1989 Sokalski ..... 106/14.15

*Primary Examiner*—R. Dean
*Assistant Examiner*—Robert R. Koehler
*Attorney, Agent, or Firm*—Flynn, Thiel, Boutell & Tanis

[57] ABSTRACT

A metal article is improved on its surface for the purpose of plating thereon by treatment with an additive of an anionic, cationic or amphoteric and water-soluble or water-self-dispersible organic polymer J, K or L. J is a polymer having an aromatic ring and OH group and a polar group. K is a polymer of hydroxystyrene having a polar group. L is a copolymer of hydroxystyrene having a polar group and a vinyl compound. The parted article is improved in corrosion resistance.

6 Claims, No Drawings

METAL SURFACE TREATMENT AND AQUEOUS SOLUTION THEREFOR

This is a division of Ser. No. 07/569,921, filed Aug. 20, 1990, now abandoned, which is a division of Ser. No. 07/285,858, filed Dec. 16, 1988, now U.S. Pat. No. 4,978,399, issued Dec. 18, 1990.

This invention relates to an additive for metal surface treatment and an aqueous solution for metal surface treatment. More particularly, the present invention is concerned with an additive for metal surface treatment and an aqueous solution for metal surface treatment which provides a remarkable improvement in the corrosion resistance and adhesion of paint to a metal surface.

PRIOR ART

A process is known in the art for pretreatment of a metal surface for chemical treatment, e.g., coating with a paint, an adhesive and a plastic, which comprises cleaning the metal surface, washing the cleaned surface with water, applying an aqueous solution for forming a chemical conversion coating to the metal surface, and thoroughly drying the resultant liquid film. This process brings about the formation of a thin non-metallic coating on a metal and results in a remarkable improvement in the quality of the surface through proper selection of the composition of the treating solution and reaction conditions. For example, the coating of a metal pretreated as above with a paint, an adhesive and a plastic, not only brings about the formation of a firmly adhered coating but also contributes to a remarkable improvement in the corrosion resistance.

Examples of this type of process well known to the art include the formation of various types of chromate coatings through the use of chromium. However, the use of chromium necessitates the provision of a pollution control facility for the purpose of removing chromium from a waste liquid treating solution and preventing the occurrence of environmental pollution, and the construction cost of this facility is huge.

For this reason, in recent years, treating solutions free from chromium have been studied. In particular, proposals have been made on a process for forming a chemical conversion coating on the surface of aluminum, and examples thereof include processes wherein the treatment is conducted by making use of a composition comprising specified amounts of zirconium and/or titanium and a phosphate and an available fluoride (see U.S. Pat. No. 4,148,670), a composition comprising polyacrylic acid and/or ester thereof and hexafluorozirconic acid, hexafluorotitanic acid, or hexafluorosilicic acid (see U.S. Pat. No. 4,191,596), and a composition comprising tannin, titanium, and fluoride ions (see U.S. Pat. No. 4,054,466).

However, the chemical conversion coatings prepared by these processes are inferior in performance, such as adhesion to paint and as a corrosion-resistant paint, to that of a chromate-treated coating.

Japanese Patent Laid-Open No. 207971/1984 has proposed a process in which use is made of a water-soluble or a water-dispersible organic polymer having a particular substituent. However, this process as well is unable to form a coating having sufficient performance with respect to the corrosion resistance, adhesion to paint, etc.

SUMMARY OF THE INVENTION

An object of the present invention is to provide a chemical conversion coating having a high corrosion resistance and high adhesion to paint on the surface of a metal.

Specifically, the present invention provides an additive for metal surface treatment and an aqueous solution for metal surface treatment which can impart to the surface of a metal, such as aluminum (including an aluminum alloy) steel or zinc, a corrosion resistance and an adhesion to paint equal or superior to that attained by chromate treatment.

Chromate treatment applied to, e.g., galvanized iron sheet not only brings about a problem of wastewater treatment but also has a drawback that satisfactory performance is not attained with respect to adhesion to paint although it provides excellent corrosion resistance. Accordingly, it is also possible to improve the adhesion of a chromate coating to paint through the application of the present invention as compared with chromate treatment.

The present inventors have made extensive and intensive studies with a view to solving the above-described problems and, as a result, have found that the use of a water-soluble or a self-water-dispersible organic polymer having a particular structure for metal surface treatment enables the attainment of high corrosion resistance and adhesion to paint, which has led to the completion of the present invention.

The invention provides a method for treating a metal article on its surface with an aqueous solution comprising a metal ion and an additive selected from anionic, cationic or amphoteric and water-soluble or water-self-dispersible organic polymers J, K and L, each defined below.

Of course two or more polymers of J, K and L may be used at a time.

The metal is preferred to be one or more of Ti, Zr, Hf, Zn, Ni, Co, Cr, Mn, Al, Ca and Mg.

The invention moreover provides an aqueous solution comprising at least one metal and the additive as defined above.

The invention will be described below together with the definition of the polymers J, K and L.

Explanation about the definition of water solubility and the use of polymer J, also applies to polymers K and L.

Polymer J

Accordingly, the present invention provides an additive for metal surface treatment comprising an anionic, cationic or amphoteric and water-soluble or self-water-dispersible organic polymer composed of a condensation polymer having a weight-average molecular weight of 1,000 to 1,000,000 or a modified natural polymer having at least one aromatic ring and 1 to 10 hydroxyl groups (—OH) on the average per 500 units of the molecular weight and further, as an indispensable component, 0.1 to 4 sulfonic groups (—$SO_3$) on the average or 0.1 to 5 groups on the average, based on 500 units of the molecular weight, of at least one polar group selected from the group (a) consisting of a phosphate group represented by the formula

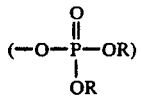

wherein R is a hydrogen atom or a hydrocarbon group (the same shall apply hereinafter); a phosphite group represented by the formula

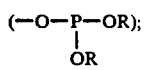

a phosphonate group represented by the formula

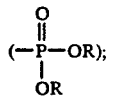

a phosphonite group represented by the formula

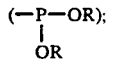

a phosphinate group represented by the formula

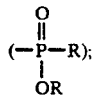

a phosphinite group represented by the formula

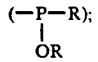

a tertiary amino group represented by the formula

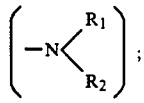

a quaternary ammonium group represented by the formula

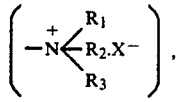

wherein $R_1$, $R_2$ and $R_3$ which may be the same or different, are each a straight chain or branched alkyl or hydroxyalkyl group or an aromatic group, such as a phenyl group or a benzyl group, and X is a counter anion; and a carboxyl group represented by the formula —COOH, and an aqueous solution comprising an additive of the kind as described above and additionally at least one metallic ion selected from among Zn, Ni, Co, Cr, Ti, Zr, Hf, Mn, Al, Ca and Mg.

The use of the aqueous solution for metal surface treatment according to the present invention enables the formation of a coating having particularly excellent corrosion resistance and adhesion to paint.

The term "water-soluble" used in the present invention is intended to mean such a state that 0.1 g or more of an organic polymer is completely dissolved at 25° C. in 1 l of an aqueous solution for standard surface treatment (solutions A to D shown in Table 2 in an working example which will be described later). Further, the term "self-water-dispersible" is intended to mean such a state that 0.01 g or more of an organic polymer is self-dispersed at 25° C. in 1 l of the above-described aqueous solution.

Examples of the water-soluble or self-water-dispersible organic polymer which may be used in the present invention include the following two groups (a) and (b) of polymers. Examples of a polymer belonging to group (a) include a water-soluble or self-water-dispersible polymer having a weight average molecular weight of 1,000 to 1,000,000 and at least one aromatic ring per 500 units of molecular weight, and examples of a polymer belonging to group (b) include a water-soluble or self-water-dispersible polymer having a weight average molecular weight of 1,000 to 1,000,000 and at least one aromatic ring having at least one hydroxyl group as a substituent

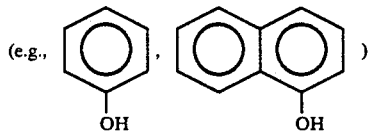

per 500 units of molecular weight.

The above-described water-soluble or self-water-dispersible organic polymers belonging to groups (a) and (b) may contain, in their side chains, functional groups other than those described above, e.g., halogen groups such as Cl and Br, and nitrile, nitro and ester groups.

Examples of the water-soluble or self-water-dispersible organic polymer meeting the requirements of the groups (a) and (b) include the following compounds A-1 to A-10.

A-1: a phenol-formaldehyde resin (a novolak resin), a phenol-furfural resin, a resorcinolformaldehyde resin, and a sulfonate of their derivatives.

A-2: sodium sulfonate of bisphenol A and a condensate of formalin with sodium sulfonate of bisphenol S.

A-3: a sulfonate of polyhydroxyvinylpyridine.

A-4: a salt of a condensate of formalin with a sulfated creosote oil, a salt of condensate of formalin with a sulfonation product of an alkylphenol and its derivative including a m-cresolmethylenesulfonic acid-formalin condensate, a condensate of formalin with sodium m-cresolbakelitemethylenesulfonate and Schaeffer's acid and a condensate of formalin with 2-(2'-hydroxyphenyl)-2-(2'-hydroxy)-sulfomethylpropane, or a salt of a condensate of formalin with a sulfonation product of phenols and a phenolic carboxylic acid. Examples of the phenols include phenol, o-cresol, m-cresol, p-cresol, 3,5-xylenol, carvacrol, thymol, catechol, resorcinol, hydroquinone, pyrogallol and phloroglucinol.

Examples of the phenolic carboxylic acid include salicylic acid, m-hydroxybenzoic acid, p-hydroxybenzoic acid, protocatechuic acid, gentisic acid, α-resorcylic acid, β-resorcylic acid, γ-resorcylic acid, orsellinic acid, caffeic acid, umbellic acid, gallic acid, and 3-hydroxyphthalic acid.

A-5: a condensate of formalin with a sulfonation product of mono- or polyhydroxynaphthalene and a derivative thereof.

Examples of the monohydroxynaphthalene include α-naphthol and β-naphthol. Examples of the polyhydroxynaphthalene include α-naphthohydroquinone (1,4-dihydroxynaphthalene), β-naphthohydroquinone (1,2-dihydroxynaphthalene), naphthopyrogallol (1,2,3-trihydroxynaphthalene), and naphthoresorcinol (1,3-dihydroxynaphthalene).

A-6: a condensate of formalin with phenylphenolsulfonate.

A-7: a condensate of formalin with dihydroxydiphenyl sulfone.

A condensate of formalin with bis(hydroxyphenyl) sulfone naphthalenesulfonate, a condensate of formalin with bis(hydroxydiphenyl) sulfone monomethylsulfonate, and a condensate of formalin with hydroxydiphenyl sulfone.

A-8: ligninsulfonic acid or salt thereof, which is a compound prepared by treating a pulp mill waste liquor produced as a by-product by various processes and mainly composed of ligninsulfonate and or salt thereof.

Lignin has a chemical structure comprising a three-dimensional structure composed of a phenylpropane group as the basic skeleton.

With respect to ligninsulfonic acid and salts thereof, various types of products are manufactured and sold by various pulp manufacturers. The molecular weight of the products ranges from 180 to 1,000,000, and the products are available in various types, i.e., have various degrees of sulfonation, are in various salts form and chemically modified form, and contain various heavy metal ions. All of these types of ligninsulfonic acid and salts thereof are not always useful for attaining the object of the present invention. The effect greatly varies depending upon the types. The object of the present invention can be most effectively attained when a particular ligninsulfonic acid and salt thereof are used. That is, there is a limitation to preferable liginsulfonic acid and salt thereof which may be used in the present invention. Specifically, in the present invention, a preferred ligninsulfonic acid and salt thereof are those which meet both of the following requirements 1:

1) one in which a lower-molecular component having a molecular weight less than 1,000 and a high-molecular weight component having a molecular weight of 500,000 or more have been industrially removed or one in which the content of a component having a molecular weight less than 1,000 and that of a component having a molecular weight of 500,000 or more are each very small, a peak of the molecular weight distribution exists within a molecular weight range from 1,000 to 500,000, and at least 50% of the components fall within the above-described molecular weight range.

There is no particular limitation to the types of the ligninsulfonate used in the present invention, and sodium, potassium, calcium, ammonium, chromium, iron, aluminum, manganese, and magnesium salts may be used in the present invention. Preferred salts are those meeting the above-described requirements 1.

A ligninisulfonic acid and salts thereof which have chelated with heavy metal ions, such as Fe, Cr, Mn, Mg, Zn or Al ions, may also be used in the present invention. Preferred examples thereof are those which meet the above-described requirements 1 and 2.

Further, a ligninsulfonic acid and salts thereof to which other organic compounds, such as naphthalene or phenol, or organic polymers have been added may also be used in the present invention. Preferred examples thereof are those which meet the above-described requirements 1 and 2. The liginsulfonic acid and salts thereof used in the present invention may contain impurities derived from the manufacture of pulp. However, the smaller the amount of the impurities, the better the effect of the compound.

A-9: a sulfonation product of polytannic acid and a derivative thereof.

A-10: a sulfonation product of humic acid or nitrated humic acid and a derivative thereof or a salt thereof.

Examples of the water-soluble or self-water-dispersible organic polymer further include the following polymers B-1 to B-3:

B-1: an anionic or amphoteric and water-soluble or self-water-dispersible organic polymer prepared by introducing at least one polar group selected from among those of the following group (I) into a base polymer composed of the above-described water-soluble or self-water-dispersible organic polymers A-1 to A-8:

polar groups of group (I): tertiary amino, quaternary ammonium, carboxyl, phosphate, phosphite, phosphonate, phosphonite, phosphinate, and phosphinite groups; or an anionic, cationic or amphoteric and water-soluble or self-water-dispersible organic polymer prepared by introducing at least one polar group selected from among those of the above-described group (I) into a starting material composed of an organic polymer before sulfonation in the organic polymers A-1, A-2, A-3, A-4 and A-8; or a compound prepared by modifying the following starting material composed of the formalin condensate A-4, A-5, A-6, or A-7 which has been deprived of the sulfone group:

A-4': a condensate of formalin with phenol, a phenolic carboxylic acid, or an alkylphenol and a derivative thereof, A-5': a condensate of formalin with mono- or polyhydroxynaphthalene and a derivative thereof, A-6': a condensate of formalin with phenylphenol, A-7': a condensate of formalin with dihydroxydiphenyl or the like i.e., an anionic, cationic or amphoteric and water-soluble or self-water-dispersible organic polymer prepared by introducing at least one polar group selected from among those of the above-described group (I) into a starting material composed of the above-described polymers A-4' to A-7'.

B-2: a sulfonation product of a condensate of formalin with phenylphosphonic acid and a derivative thereof and phenol and a derivative thereof or resorcinol or a derivative thereof; and a salt thereof.

Examples of the derivative of phenylphosphonic acid include monooctyl phenylphosphonate, diphenylphosphonic acid, O-methyl hydrogen phenylthiophosphonate and diphenylphosphinic acid.

Examples of the derivative of resorcinol include 2,6-dihydroxyacetophenone, 2,4-dihydroxyacetophenone, resorcinol monomethyl ether, resorcinol monohydroxyethyl ether, 2-methylresorcinol, 7-hydroxy-4-methylcoumarin, and 2-ethylresorcinol.

Examples of the derivative of phenol include all of the phenols, phenolic carboxylic acids and alkylphenols described above with respect to compound A-4.

B-3: humic acid, nitrohumic acid and salts thereof or amination products of these humic acids.

It is also possible to select at least one member from among the compounds of the above-described group A or B or both of the above-described groups A and B and use them in the form of a mixture. There is no limitation to the type of the salt of the organic polymer, and sodium, calcium and ammonium salts, etc. may be used.

The weight-average molecular weight of the water-soluble or self-water-dispersible organic polymer which may be used in the present invention is limited to 1,000 to 1,000,000, preferably 1,000 to 500,000, most preferably 2,000 to 100,000. This is because the effect of the present invention is dependent on the molecular weight of the organic polymer. Specifically, when the polymer has a molecular weight as low as less than 1,000, it is difficult to attain a remarkable effect of adhesion to paint. On the other hand, when the molecular weight exceeds 1,000,000, not only the solubility or dispersibility of the organic polymer in an aqueous solution is lowered but also it becomes difficult to attain the effect of the present invention.

The water-soluble or self-water-dispersible organic polymer according to the present invention can be used in the form of an aqueous solution having a polymer concentration of about 0.005 to about 20% by weight, more preferably 0.01 to 5% by weight.

The water-soluble or self-water-dispersible organic polymer according to the present invention can be applied to the treatment of the surface of metals, such as aluminum (including an aluminum alloy), steel or zinc, and exhibits a particularly high effect when applied to the surface treatment of aluminum. The surface treatment may be conducted by generally known processes such as immersion and spray processes.

The metal surface which has been treated with the product according to the present invention can be coated with paint through usual coating processes such as brush coating, spray coating, electrostatic coating, immersion coating, and roller coating.

The treatment according to the present invention enables a metal surface to have levels of high corrosion resistance and high adhesion to paint which have not been attained by the prior art.

Polymer K

Accordingly, the present invention provides an additive for metal surface treatment comprising an anionic, cationic or amphoteric and water-soluble or self-water-dispersible organic polymer of hydroxystyrene represented by the following general formula (K):

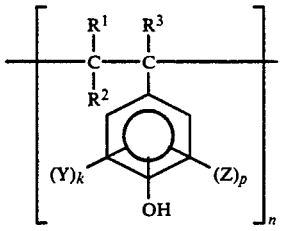

(K)

wherein n is 3 or more and is a number necessary for said organic polymer represented by the general formula (K) to have a weight average molecular weight up to 1,000,000;

$0<k\leqq 2$;

$0<p\leqq 2$;

$R^1$ to $R^3$ are each H or an alkyl group having 1 to 5 carbon atoms;

Y is $-SO_3M$ or

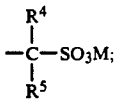

and

Z is a group selected from among $-y^1$, $-OCH_3$,

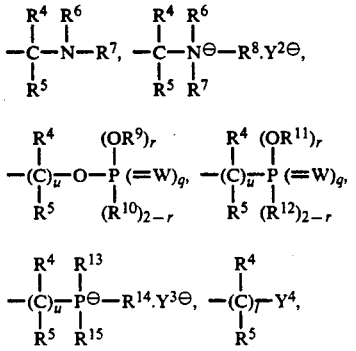

alkyl groups each having 1 to 18 carbon atoms and aryl groups, wherein M is H, an alkali metal, an alkaline earth metal, or an organic cation of an amine etc.;

$Y^1$ and $Y^4$ are each a halogen;

$Y^{2\ominus}$ and $y^{3\ominus}$ are each a counter ion such as a halogen ion, an organic acid anion, or an inorganic acid anion;

W is S or O;

$R^4$ to $R^8$, which may be the same or different, are each a straight-chain or branched alkyl group, an alkyl group derivative such as a hydroxyalkyl group, an aromatic group, or H, provided that $R^6$ and $R^7$ may be combined to form a ring together with the N group;

$R^9$ to $R^{15}$, which may be the same or different, are each a straight-chain or branched alkyl group, an alkyl group derivative such as a hydroxyalkyl group, an aromatic group, or H;

q, s, t, and u are each 0 or 1; and r is 0, 1, or 2, and further provides an aqueous solution for metal surface treatment characterized by comprising an additive of the kind as described above as an indispensable ingredient and, further, at least one metallic ion selected from among Ti, Zr, Hf, Zn, Ni, Co, Cr, Mn, Al, Ca, and Mg.

In the above-described general formula (K), n, k, and p are each not limited to being an integer and may be any number (a real number) in a particular range. On the level of a monomer constituting a polymer, it is a matter of course that k and p are each an integer, while on the level of a molecule, n is an integer. However, a polymer is essentially a mixture, and it is more proper to regard the property of the mixture as the property of the polymer than to judge the property of the polymer from that of the individual constituent unit. Therefore, in the present invention, the general formula (K) represents an average composition.

The organic polymer of hydroxystyrene represented by the general formula (K) has a substituent Y as an indispensable substituent in the general formula (K), i.e., $-SO_3M$ or

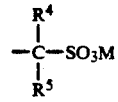

wherein M is H, an alkali metal, an alkaline earth metal, or an organic cation of an amine etc., and may optionally have a substituent represented by Z.

Suitable examples of the alkali metal or alkaline earth metal M in the substituent Y include Li, Na, K, Mg, Ca, Sr, and Ba.

Hydroxystyrene or isopropenylphenol which is a polymer unit of the hydroxystyrene polymer may be an ortho, meta or para isomer or a mixture of them, among which a para or meta isomer is preferable.

The introduction of the sulfonic group can be attained by an ordinary sulfonation process in which fuming sulfuric acid, sulfuric anhydride, or the like is used as a sulfonating agent.

$R^4$ to $R^8$ in the substituent

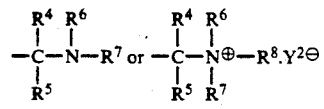

which may be the same or different are selected from among a straight-chain or branched alkyl group having 1 to 36 carbon atoms, an alkyl derivative group such as a hydroxyalkyl, aminoalkyl, phosphoalkyl or mercaptoalkyl group, and an aromatic group such as a benzyl group substituted with a straight-chain or branched alkyl group having 1 to 16 carbon atoms, provided that the carbon chain has such a length as will cause the water-solubility or self-water-dispersibility of the above-described compound (K) to disappear. $R^6$ and $R^7$ may be combined to form a ring. Therefore, preferably examples of $R^4$ to $R^8$ include a straight-chain or branched alkyl group, a hydroxyalkyl group, or an aromatic group substituted with a straight-chain or branched alkyl group having 1 to 5 carbon atoms. With respect to the introduction of the above-described tertiary amino group,

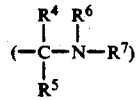

can easily be prepared by, e.g., the Mannich reaction in which a dialkylamine and formaldehyde are employed.

An organic or inorganic acid for neutralizing the amino moiety may be used in order to improve the water-solubility or self-water-dispersibility. Examples of acids useful for this purpose include acetic acid, citric acid, oxalic acid, ascorbic acid, phenylsulfonic acid, chloromethylphosphonic acid, monochloroacetic acid, dichloroacetic acid, trichloroacetic acid, trifluoroacetic acid, sulfuric acid, phosphoric acid, hydrochloric acid, boric acid, nitric acid, hydrofluoric acid, hexafluorosilisic acid, hexafluorotitanic acid, and hexafluorozirconic acid. They may be used alone or in the form of a mixture of them.

With respect to the introduction of the quaternary ammonium base,

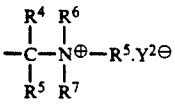

can easily be prepared by, e.g., the Menshutkin reaction, which is a reaction of the above-described tertiary amine compound with an alkyl halide. $R^9$ to $R^{15}$ in the following substituents of the hydroxystyrene unit:

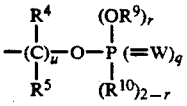

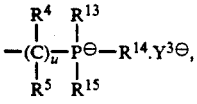

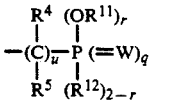

may be the same or different and are selected from among a straight-chain or branched alkyl group having 1 to 36 carbon atoms, an alkyl derivative group such as a hydroxyalkyl, aminoalkyl, mercaptoalkyl or phosphoalkyl group, and an aromatic group such as a phenyl group substituted with a straight-chain or branched alkyl group having 1 to 16 carbon atoms, provided that the carbon chain has such a length as will cause the water-solubility or self-water-dispersibility of the above-described compound (K) to disappear. In view of the above, preferable examples of $R^9$ to $R^{15}$ include a straight-chain or branched alkyl or hydroxyalkyl group having 1 to 8 carbon atoms, or an aromatic group substituted with a straight-chain or branched alkyl group having 1 to 5 carbon atoms. The hydroxystyrene polymer represented by the formula (II) can be prepared by, e.g., a process described in Japanese Patent Laid-Open No. 47489/1978, i.e., by halogenating or halomethylating a hydroxystyrene polymer, reacting the product with a trivalent phosphorus compound (Arbuzov reaction), and subjecting the reaction product to thermal rearrangement. The hydroxystyrene polymer represented by the formula (I) can be prepared by, e.g., a process described in Japanese Patent Laid-Open No. 71190/1978, i.e., by hydroxymethylating a hydroxystyrene polymer and reacting the product with a reagent for introducing a phosphoric acid or ester group. A hydroxystyrene polymer substituted by a phosphonium group represented by the formula

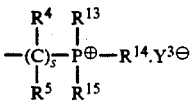

can easily be prepared by, e.g., a process described in JP-B 53-34444, i.e., by reacting a hydrogen halide and formaldehyde with a hydroxystyrene polymer to effect halogenomethylation (e.g., chloromethylation) and then reacting a trivalent phosphite with the product. The hydroxystyrene polymer may be one prepared by any process, and it does not matter how the polymer has been prepared.

The weight-average molecular weight of the water-soluble or self-water-dispersible organic polymer which may be used in the present invention is preferably at least 1,000 and should be 1,000,000 or less. The weight-average molecular weight of the polymer is preferably 1,000 to 500,000, most preferably 2,000 to 100,000. This is because the effect of the present invention is dependent on the molecular weight of the organic polymer. Specifically, when the polymer has a molecular weight as low as less than 1,000, it is difficult to attain a remarkable effect of adhesion to paint. On the other hand, when the molecular weight exceeds 1,000,000, the solubility or dispersibility of the organic polymer in an aqueous solution is lowered, which not only brings about a problem of the limitation of the concentration of addition of the organic polymer to an aqueous solution for surface treatment but also makes it difficult to attain the effect of the present invention. The weight average molecular weight is most preferably 2,000 to 100,000 from the viewpoint of the solubility or dispersibility in an aqueous solution for surface treatment, easiness of development of a function, such as adhesion to paint, or the like.

The density of polar groups exclusive of a hydroxyl group and an aromatic ring, such as sulfonic and phosphate groups, is preferably 0.1 to 5 on the average, more preferably 1 to 3 on the average, based on 500 units of the molecular weight from the viewpoint of the solubility or dispersibility of the organic polymer in the aqueous solution. When the polar group density is less than 0.1, there occurs a problem of poor solubility or dispersibility in the aqueous solution. On the other hand, when the polar group density exceeds 5, there occurs a problem of a lowering in the corrosion resistance of the resultant coating. A sulfonic group is an indispensable polar group, and a phosphorus-containing group or an amine group is another preferable polar group. An organic polymer having these polar groups exhibits excellent adhesion to paint.

The present inventors have made extensive and intensive studies on the behavior of a polyhydroxystyrene derivative in a liquid containing a metallic ion, such as a surface treatment solution, and, as a result, have found that an anionic polar group (especially a sulfonic group) is effective.

More particularly, the present inventors have found that a sulfonic group enables a coating to exhibit very strong adhesion to paint and provide excellent corrosion resistance because the sulfone group is incorporated in a chemical conversion coating in a chemically stable state by virtue of a strong electrostatic interaction between the sulfonic group and the metallic cation. The reason why the corrosion resistance is improved is thought to reside in that polyhydroxystyrene having a sulfonic group as a substituent is less susceptible to redissolution in the solution because it stably exists in a chemical conversion coating. When polyhydroxystyrene has only an amino group as the substituent, none of the above-described effects can be expected.

Polymer L

Accordingly, the present invention provides an additive for metal surface treatment comprising an anionic, cationic or amphoteric and water-soluble or self-water-dispersible organic polymer of hydroxystyrene represented by the following general formula (L):

(L)

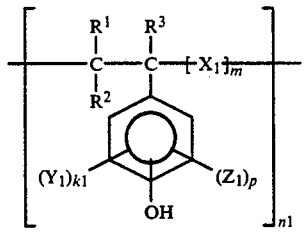

wherein $m>0$ and $n1 \geqq 3$ and each is a number necessary for said organic polymer represented by the general formula (L) to have a weight average molecular weight up to 1,000,000;

$0 \leqq k1 \leqq 2$;

$0 \leqq p \leqq 2$;

$R^1$ to $R^3$ are each H or an alkyl group having 1 to 5 carbon atoms;

X is a polymerizable vinyl monomer;

Y1 and Z1, which may be the same or different, are each selected from among

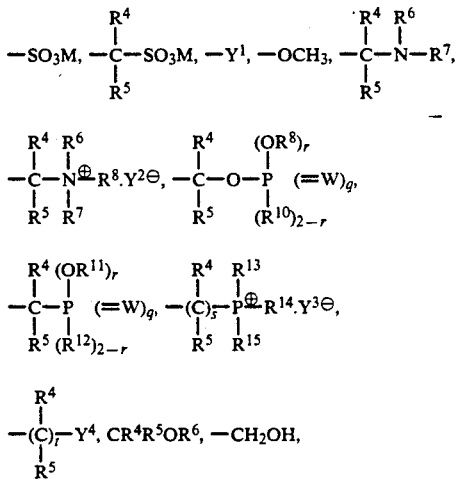

alkyl groups each having 1 to 18 carbon atoms and aryl groups, wherein M is H, an alkali metal, an alkaline earth metal, or an organic cation of an amine etc.;

$Y^1$ and $Y^4$ are each a halogen;

$y^{2\ominus}$ and $y^{3\ominus}$ are each a counter ion such as a halogen ion, an organic acid anion, or an inorganic acid anion;

W is S or O;

$R^4$ to $R^8$, which may be the same or different, are each a straight-chain or branched alkyl group, an alkyl group derivative such as a hydroxyalkyl group, an aromatic group, or H, provided that $R^6$ and $R^7$ may be combined to form a ring together with the N group;

$R^9$ to $R^{15}$, which may be the same or different, are each a straight-chain or branched alkyl group, an alkyl group derivative such as a hydroxyalkyl group, an aromatic group, or H;

q, s, and t are each 0 to 1; and r is 0, 1, or 2, and further provides an aqueous solution for metal surface treatment characterized by comprising an additive of the kind as described above as an indispensable ingredient and further at least one metallic ion selected from among Ti, Zr, Hf, Zn, Ni, Co, Cr, Mn, Al, Ca, and Mg.

In the above-described general formula (A) m, n, k, and p are each not limited to an integer and may be any number (a real number) in a particular range. On the level of a monomer constituting a polymer, it is a matter of course that k and p are each an integer. On the level of a block of structural units, m is an integer, and on the level of a molecule, n is an integer. However, a polymer is essentially a mixture, and it is more proper to regard the property of the mixture as the property of the polymer than to judge the property of the polymer from that of the individual constituent unit. Therefore, in the present invention, the general formula (L) represents an average composition.

The organic polymer of hydroxystyrene represented by the general formula (L) is a copolymer of a hydroxystyrene monomer having or free from a substituent represented by Y1 or Z1 in the general formula (L), such as hydroxystyrene, isopropenylphenol (hydroxy-α-methylstyrene) or hydroxy-α-ethylstyrene, with another vinyl monomer (X1). Hydroxystyrene, isopropenylphenol, or the like, which is a polymer unit, may be an ortho, meta or para isomer or a mixture of them, among which a para or meta isomer is preferable.

Examples of the vinyl monomer (X1) which is the other polymer unit, include maleic anhydride, maleic acid, acrylic acid, methyl methacrylate, methacrylic acid, glycidyl methacrylate, hydroxyethyl methacrylate, itaconic acid, allylsulfonic acid, styrenesulfonic acid, ethyl acrylate phosphate, acrylamide, 2-acrylamido-2-methylpropanesulfonic acid, acrylonitrile, maleimide, vinylpyridine, acrylic ester, methacrylic ester, fumarate, or vinyl esters of various organic acids. In this case, the molar ratio of the hydroxystyrene compound unit, such as hydroxystyrene or isopropenylphenol unit, to the other vinyl monomer is preferably 1/10 to 20/1.

Suitable examples of the alkali metal or alkaline earth metal M in the substituent of the hydroxystyrene unit, i.e., $-SO_3M$ or

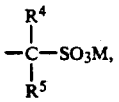

include Li, Na, K, Mg, Ca, Sr, and Ba.

The introduction of the sulfonic group can be attained by an ordinary sulfonation process in which fuming sulfuric acid, sulfuric anhydride, or the like is used as a sulfonating agent.

$R^4$ to $R^8$ in the substituent

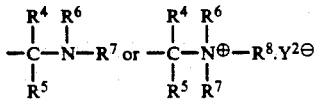

which may be the same or different, are selected from among a straight-chain or branched alkyl group having 1 to 36 carbon atoms, an alkyl derivative group such as a hydroxyalkyl, aminoalkyl, phosphoalkyl or mercaptoalkyl group, and an aromatic group such as a benzyl group substituted with a straight-chain or branched alkyl group having 1 to 16 carbon atoms, provided that the carbon chain has such a length as will cause the water-solubility or self-water-dispersibility of the above-described compound (L) to disappear. $R^6$ and $R^7$ may be combined to form a ring. Therefore, preferable examples of $R^4$ to $R^8$ include a straight-chain or branched alkyl group, a hydroxyalkyl group, or an aromatic group substituted with a straight-chain or branched alkyl group having 1 to 5 carbon atoms. With respect to the introduction of the above-described tertiary amino group,

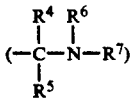

can easily be prepared by, e.g., the Mannich reaction in which a dialkylamine and formaldehyde are employed.

An organic or inorganic acid for neutralizing the amino moiety may be used in order to improve the water-solubility or self-water-dispersibility. Examples of acids useful for this purpose include acetic acid, citric acid, oxalic acid, ascorbic acid, phenylsulfonic acid, chloromethylphosphonic acid, monochloroacetic acid, dichloroacetic acid, trichloroacetic acid, trifluoroacetic acid, sulfuric acid, phosphoric acid, hydrochloric acid, boric acid, nitric acid, hydrofluoric acid, hexafluorosilisic acid, hexafluorotitanic acid, and hexafluorozirconic acid. They may be used alone or in the form of a mixture of them.

With respect to the introduction of the quaternary ammonium,

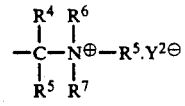

can easily be prepared by, e.g., the Menshutkin reaction, which is a reaction of the above-described tertiary amine compound with an alkyl halide.

$R^9$ to $R^{15}$ in the following substituents of the hydroxystyrene unit:

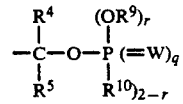

(III)

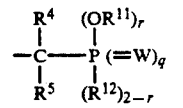

(IV)

may be the same or different and are selected from among a straight-chain or branched alkyl group having 1 to 36 carbon atoms, an alkyl derivative group such as a hydroxyalkyl, aminoalkyl, mercaptoalkyl or phosphoalkyl group, and an aromatic group such as a phenyl group substituted with a straight-chain or branched alkyl group having 1 to 16 carbon atoms, provided that the carbon chain has such a length as will cause the water-solubility or self-water-dispersibility of the above-described compound (L) to disappear. In view of the above, preferable examples of $R^9$ to $R^{15}$ include a straight-chain or branched alkyl or hydroxyalkyl group having 1 to 8 carbon atoms, or an aromatic group substituted with a straight-chain or branched alkyl group having 1 to 5 carbon atoms. The hydroxystyrene polymer represented by the formula (IV) can be prepared by, e.g., a process described in Japanese Patent Laid-Open No. 47489/1978, i.e., by halogenating or halomethylating a hydroxystyrene polymer, reacting the product with a trivalent phosphorus compound (Arbuzov reaction), and subjecting the reaction product to thermal rearrangement. The hydroxystyrene polymer represented by the formula (III) can be prepared by, e.g., a process described in Japanese Patent Laid-Open No. 71190/1978, i.e., by hydroxymethylating a hydroxystyrene polymer and reacting the product a reagent for introducing phosphoric acid or ester group. A hydroxystyrene polymer substituted by a phosphonium group represented by the formula

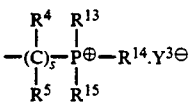

can easily be prepared by, e.g., a process described in Japanese Patent Laid-Open No. 34444/1986, i.e., by reacting a hydrogen halide and formaldehyde with a hydroxystyrene polymer to effect halogenomethylation (e.g., chloromethylation) and then reacting a trivalent phosphite with the product. The hydroxystyrene polymer may be one prepared by any process, and it does not matter how the polymer has been prepared.

The weight average molecular weight of the water-soluble or self-water-dispersible organic polymer which may be used in the present invention is preferably at least 1,000 and should be 1,000,000 or less. The weight-average molecular weight of the polymer is preferably 1,000 to 500,000, most preferably 2,000 to 100,000. This is because the effect of the present invention is dependent on the molecular weight of the organic polymer. Specifically, when the polymer has a molecular weight as low as less than 1000, it is difficult to attain a remarkable effect of adhesion to paint. On the other hand, when the molecular weight exceeds 1,000,000, the solubility or dispersibility of the organic polymer in an aqueous solution is lowered, which not only brings about a problem of the limitation of the concentration of addition of the organic polymer to an aqueous solution for surface treatment but also makes it difficult to attain the effect of the present invention. The weight average molecular weight is most preferably 2,000 to 100,000 from the viewpoint of the solubility or dispersibility in an aqueous solution for surface treatment, easiness of development of a function, such as adhesion to paint, or the like.

The density of polar groups exclusive of a hydroxyl group and an aromatic ring, such as sulfonic and phosphate groups, is preferably 0.1 to 5 on the average, more preferably 1 to 3 on the average, based on 500 units of the molecular weight from the viewpoint of the solubility or dispersibility of the organic polymer in the aqueous solution. When the polar group density is less than 0.1, there occurs a problem of poor solubility or dispersibility in the aqueous solution. On the other hand, when the polar group density exceeds 5, there occurs a problem of a lowering in the corrosion resistance of the resultant coating. The polar group is preferably a sulfonic group, a phosphorus-containing group or an amine group. This is because an organic polymer having these polar groups exhibits excellent adhesion to paint.

The present inventors have made extensive and intensive studies on the behavior of a polyhydroxystyrene derivative in a liquid containing a metallic ion, such as a surface treatment solution, and, as a result, have found that the introduction of various polar groups into a hydroxystyrene skeleton contributes to an improvement in the function of a chemical conversion coating.

However, mere introduction of a polar group into a hydroxystyrene skeleton brings about a problem with respect to the solubility or dispersibility or dispersibility in the solution.

The present inventors have made extensive and intensive studies with a view to solving this problem and, as a result, have found a copolymer having excellent solubility and dispersibility in a treating solution and capable of imparting excellent corrosion resistance and adhesion to paint to a chemical conversion coating through copolymerization of a hydroxystyrene derivative with other vinyl monomer.

EXAMPLES

The present invention will now be described in more detail with reference to the following Examples which should not be construed as limiting the scope of the present invention.

Water-soluble and self-water-dispersible polymers used here are listed in Table 1J, 1K and 1L and surface treating solutions and treating methods are shown in Table 2, while paints and coating methods are shown in Table 3.

The corrosion resistance and the adhesion to paint were evaluated by the following methods.

Evaluation of corrosion resistance

I: A test sample was sprayed with salt water according to JIS Z-2371, and the corrosion resistance was expressed in terms of time taken for causing blistering at the crosscut portion of the coating.

II: A specimen prepared by conducting cross-cutting after coating was continuously sprayed with an aqueous 5% sodium chloride solution according to JIS Z-2371 and then subjected to a tape peeling test of the crosscut portion. The corrosion resistance was expressed in terms of the width (single-side width) of the coating peeled along the cut line.

Evaluation criteria:

A . . . Continuous spraying for 3 weeks brought about neither peeling of more than 1 mm in width nor blistering of the coating at the peripheral portion of the crosscut.

B . . . Continuous spraying for 2 weeks brought about neither peeling of more than 1 mm in width nor blistering of the coating at the peripheral portion of the crosscut.

C . . . Continuous spraying for 1 week brought about neither peeling of more than 1 mm in width nor blistering of the coating at the peripheral portion of the crosscut.

D . . . Continuous spraying for 1 week brought about peeling of more than 1 mm in width.

E . . . Continuous spraying for 1 week brought about peeling of more than 1 mm in width and blistering of the coating at the peripheral portion of the crosscut.

Evaluation of adhesion to paint

I: Crosscut adhesion test:

100 crosscuts with a depth reaching the surface of the base metal were provided on a sample at intervals of 1 mm. The sample was subjected to a peeling test by making use of an adhesive cellophane tape. The adhesion to paint was expressed in terms of the number of crosscuts of the coating remaining unpeeled.

II: Erichsen extrusion test:

100 crosscuts with a depth reaching the surface of the base metal were provided on a sample at intervals of 1 mm. The sample was subjected to Erichsen extrusion and then a peeling test by making use of an adhesive cellophane tape. The adhesion to paint was expressed in terms of the number of crosscuts of the coating remaining unpeeled.

Criteria of evaluation:

A . . . No peeling occurred in the tape peel test after extrusion by 8 mm.

B . . . No peeling occurred in the tape peel test after extrusion by 7 mm.

C . . . No peeling occurred in the tape peel test after extrusion by 6 mm.

D . . . Peeling of less than 100/100 occurred in the tape peel test after extrusion by 5 mm.

TABLE 1J

| No. | compound | mol. wt. | | polar group density (per 500 of mol. wt.) | |
|---|---|---|---|---|---|
| 1 | sodium salt of sulfonated novolak resin | ca | 1,200 | sulfonic group | 3.8 |
| 2 | sodium salt of m-cresolmethylenesulfonic acid-formalin condensate | ca | 1,500 | sulfonic group | 3 |
| 3 | condensate of formalin with sodium m-cresolbakelitemethylenesulfonate and Schaeffer's acid | ca | 3,000 | sulfonic group | 2 |
| 4 | condensate of formalin with sodium dihydroxynaphthalenesulfonate | ca | 3,000 | sulfonic group | 1.8 |
| 5 | sodium salt of sulfonated polytannic acid | ca | 20,000 | sulfonic group | 2 |
| 6 | condensate of formalin with sodium phenyl phenoldisulfonate | ca | 6,000 | sulfonic group | 3.4 |
| 7 | sodium ligninsulfonate (1) | ca | 10,000 | sulfonic group | 1.1 |
| 8 | sodium ligninsulfonate (2) | ca | 3,600 | sulfonic group | 1.3 |
| 9 | Cr chelate of sodium ligninsulfonate | ca | 5,000 | sulfonic group | 1.3 |

TABLE 1J-continued

| No. | compound | mol. wt. | | polar group density (per 500 of mol. wt.) | |
|---|---|---|---|---|---|
| 10 | ammonium ligninsulfonate | ca | 2,000 | sulfonic group | 1.4 |
| 11 | aminated [—$CH_2N(CH_3)_2$] compound 7 | ca | 11,000 | sulfonic group<br>amino group | 1.1<br>1.2 |
| 12 | compound prepared by aminating [—$CH_2N(CH_3)_2$] compound 4 and neutralizing the product | ca | 4,000 | sulfonic group<br>amino group | 1.8<br>2.1 |
| 13 | ammonium sulfonate of nitrohumic acid | ca | 10,000 | sulfonic group<br>carboxyl group | 1.2<br>1 |
| 14 | sodium salt of sulfonated condensate of formalin with phenylphosphonic acid and phenol | ca | 3,000 | sulfonic group<br>phosphate group | 3<br>1 |
| 15 | aminomethylated novolak resin | ca | 1,400 | amino group | 3.8 |
| 16 | aminomethylated condensate of formalin with naphthol | ca | 2,500 | amino group | 3.4 |
| 17 | aminomethylated condensate of formalin with phenanthrene and phenol | ca | 3,000 | amino group | 2.0 |
| 18 | sodium salt of sulfonated condensate of formalin with phenylphosphonic acid and phenol | ca | 3,000 | sulfonic group<br>phosphate group | 3.0<br>1.0 |
| 19 | aminoethylated condensate of formalin with naphtholsulfonic acid | ca | 3,500 | sulfonic group<br>amino group | 1.6<br>1.3 |
| 20 | condensate of formalin with naphthol and phenolsulfonic acid | ca | 3,000 | sulfonic group | 0.3 |
| 21 | ammonium sulfonate of nitrohumic acid | ca | 9,000 | sulfonic group<br>carboxyl group | 0.1<br>0.6 |
| 22 | sodium ligninsulfonate (3) | ca | 3,600 | sulfonic group | 0.3 |
| 23 | aminomethylated condensate of formalin with naphthol | ca | 2,500 | amino group | 0.2 |
| R-1 | sodium sulfonate of ethyleneoxidemethoxylated naphthol | ca | 2,000 | — | |
| R-2 | sodium polyacrylate | ca | 30,000 | — | |
| R-3 | polyethyleneimine | ca | 3,000 | — | |
| R-4 | polyethylene glycol nonylphenyl ether | ca | 5,000 | — | |
| R-5 | sodium naphthalenedisulfonate | | 342 | — | |
| R-6 | vegetable tannin | ca | 1,000 | — | |

TABLE 1K

| No. | structure of hydroxystyrene polymer | wt.-av. mol. wt. ($\overline{MW}$) |
|---|---|---|
| 1 | 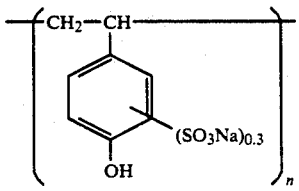 | 2,380 |

TABLE 1K-continued
| No. | structure of hydroxystyrene polymer | wt.-av. mol. wt. ($\overline{MW}$) |
|---|---|---|
| 2 | 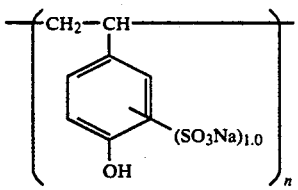 | 7,900 |
| 3 | 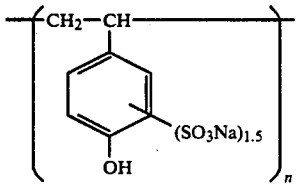 | 15,300 |
| 4 | 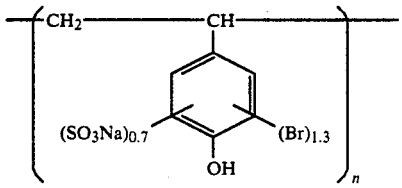 | 11,900 |
| 5 | 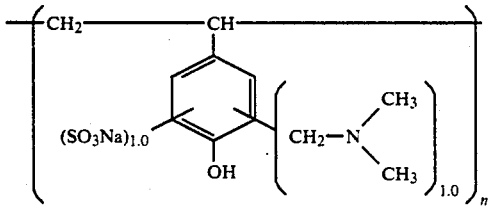 | 4,450 |
| 6 | 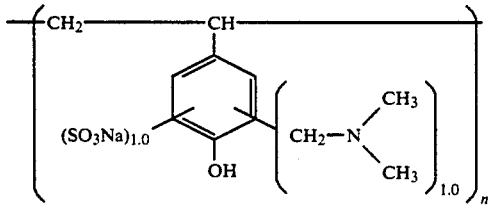 | 23,880 |
| 7 | 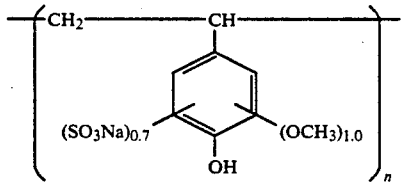 | 3,860 |
| 8 | 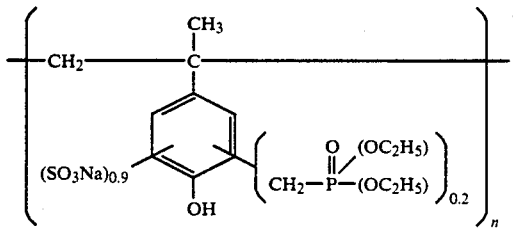 | 4,070 |

TABLE 1K-continued
| No. | structure of hydroxystyrene polymer | wt.-av. mol. wt. ($\overline{MW}$) |
|---|---|---|
| 9 | 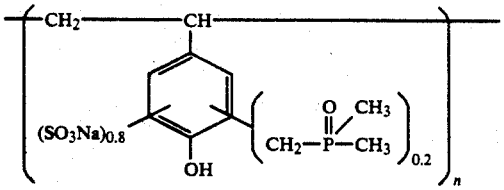 | 3,490 |
| 10 | 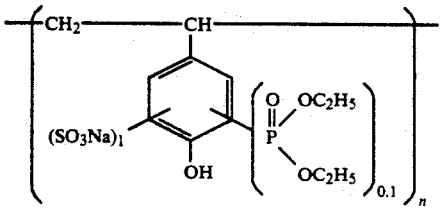 | 2,600 |
| 11 | 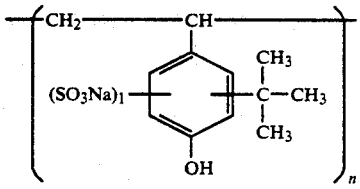 | 2,400 |
| 12 | 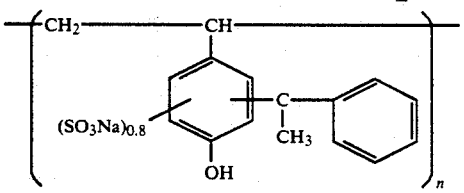 | 1,700 |
| 13 | 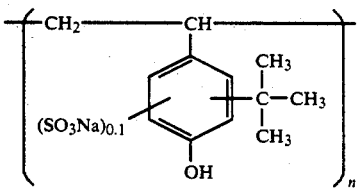 | 3,200 |
| 14 | 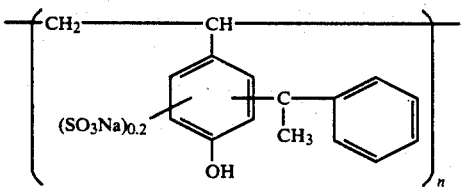 | 8,800 |
| R-1 | 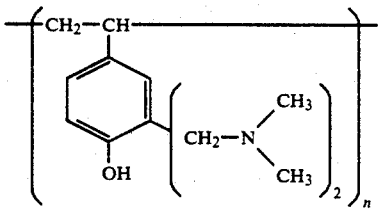 neutralized with acetic acid | 20,060 |

TABLE 1K-continued
| No. | structure of hydroxystyrene polymer | wt.-av. mol. wt. ($\overline{MW}$) |
|---|---|---|
| R-2 | 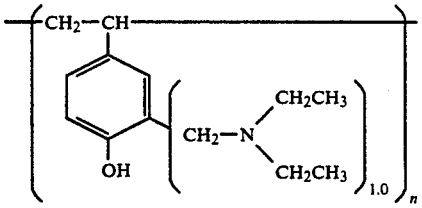 neutralized with acetic acid | 2,810 |
TABLE 1L
| No. | structure of hydroxystyrene polymer | wt.-av. mol. wt. ($\overline{MW}$) |
|---|---|---|
| 1 | 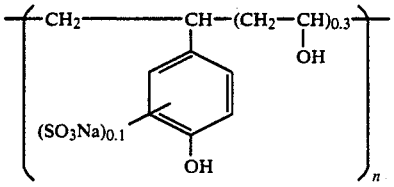 | 11,000 |
| 2 | 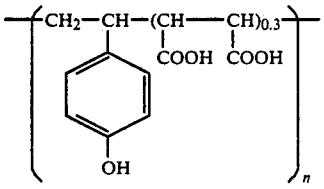 | 25,000 |
| 3 | 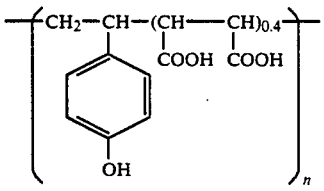 | 3,740 |
| 4 | 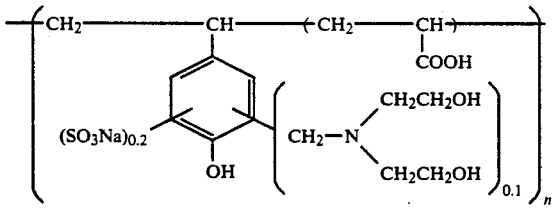 | 37,500 |
| 5 | 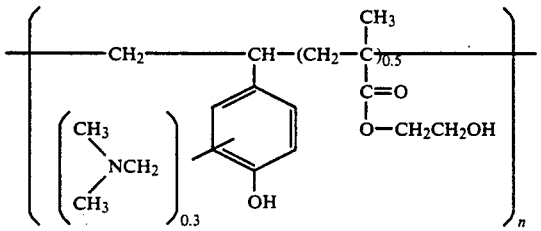 | 4,210 |

TABLE 1L-continued
| No. | structure of hydroxystyrene polymer | wt.-av. mol. wt. ($\overline{MW}$) |
|---|---|---|
| 6 | 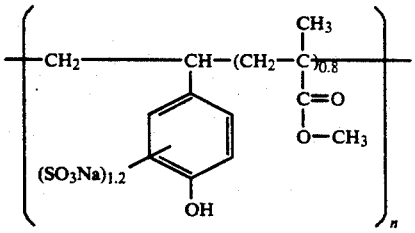 | 2,760 |
| 7 | 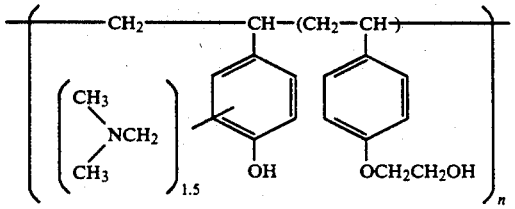 | 6,210 |
| 8 | 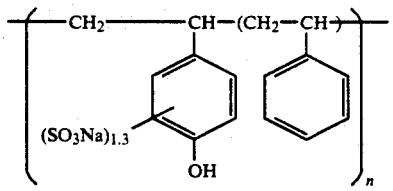 | 23,600 |
| 9 | 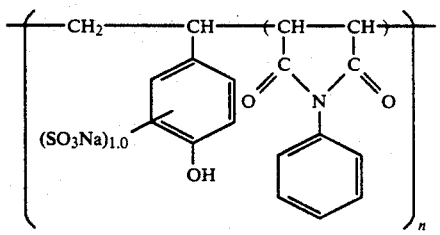 | 14,500 |
| 10 | 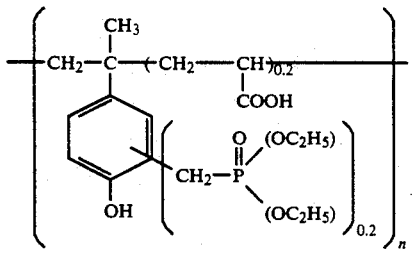 | 8,800 |
| 11 | 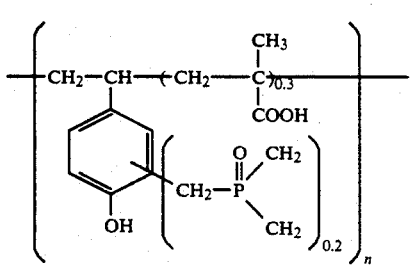 | 7,650 |

TABLE 1L-continued

| No. | structure of hydroxystyrene polymer | wt.-av. mol. wt. ($\overline{MW}$) |
|---|---|---|
| 12 | 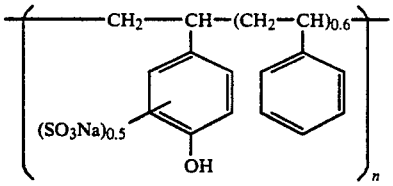 | 13,500 |
| 13 | 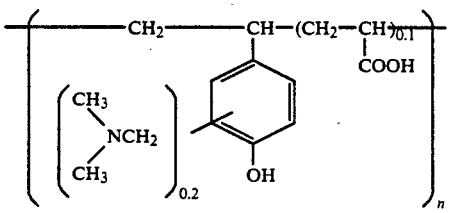 | 4,500 |
| 14 | 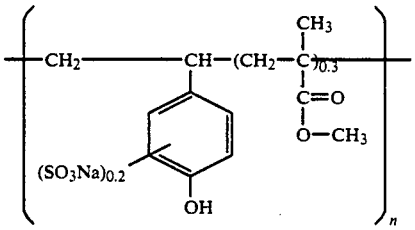 | 6,700 |
| R-1 | 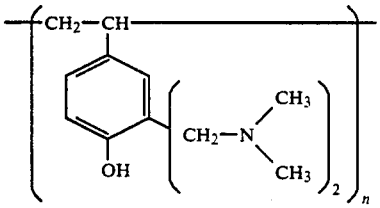 neutralized with acetic acid | 20,060 |
| R-2 | 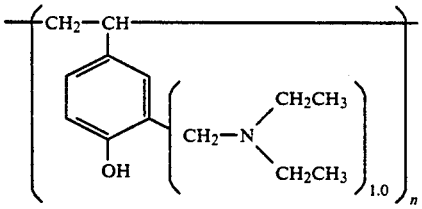 neutralized with acetic acid | 2,810 |

TABLE 2

| | | surface treating solution and treating method | | | | |
|---|---|---|---|---|---|---|
| | | treating solution | | | | |
| solution | application | kind | composition | | | treating method |
| A | for aluminum | non-chromate | $(NH_4)_2ZrF_6$ | 0.12 | g/l | sprayed with a treating solution at 35° C. and 1 kg/m$^2$ |
| | | | $H_3PO_4$ | 0.07 | g/l | |
| | | | $HBF_4$ | 0.07 | g/l | |
| | | | sodium gluconate | 0.05 | g/l | |
| B | | chromium phosphate | $CrO_3$ | 0.1 | g/l | immersed in a treating solution at 40° C. for 1 min and dried at 160° C. for 2 min |
| | | | phosphoric acid | 0.098 | g/l | |
| | | | NaF.HF | 0.02 | g/l | |
| C | for steel | phosphate | ZnO | 8 | g/l | immersed in a treating solution at 65° C. for 10 sec, pressed with rolls, and dried at 120° C. for 10 sec |
| | | | $NiCO_3$ | 1 | g/l | |
| | | | $HNO_3$ | 10 | g/l | |
| | | | $H_3PO_4$ | 70 | g/l | |
| D | | chromate | $CrO_3$ | 5 | g/l | immersed in a treating solution |

TABLE 2-continued

| surface treating solution and treating method | | | | |
|---|---|---|---|---|
| | | treating solution | | |
| solution | application | kind | composition | treating method |
| | | | $H_2SO_4$ 5.5 g/l<br>$HNO_3$ 5 g/l | at 30° C. and dried at 160° C. for 2 min |

TABLE 3

| paint and coating method | | | |
|---|---|---|---|
| symbol | kind of paint | coating thickness | coating method |
| a | alkyd-melamine paint (Kan-coat: a product of Kansai Paint Co., Ltd.) | about 20 μm | baked at 120° C. for 40 min |
| b | acrylic paint (Kan-coat: a product of Kansai Paint Co., Ltd.) | about 16 μm | baked at 210° C. for 3 min |
| c | cationic epoxy electro-paint (Elecron: a product of Kansai Paint Co., Ltd.) | about 30 μm | electrodeposited at 250 V and baked at 180° C. for 25 min |
| d | thermosetting powdery polyester paint (NPC 300; a product of Nippon Paint Co., Ltd. | about 40 μm | coated by electro-static spray coating and baked at 230° C. for 5 min |

EXAMPLE 1

An aluminum sheet A-3004 was degreased with an acid cleaning agent and then treated with a solution prepared by adding a water-soluble or self-water-dispersible polymer of Table 1J, 1K, 1L to treating solution A or B shown in Table 2. Coating of the treated sheet was conducted by the method (a) or (b) shown in Table 3. Results are shown in Table 4J, 4K, 4L.

COMPARATIVE EXAMPLE 1

Samples were treated in the same manner as that of Example 1, except that the treatment was conducted by making use of treating solution A or B shown in Table 2 after addition of a polymer other than that of the present invention or without addition of any polymer. Results are shown in Table 4J, 4K, 4L, and show the corrosion resistance and adhesion to paint of a coating formed by the surface treatment of an aluminum sheet with the water-soluble or self-water-dispersible organic polymer according to the present invention in comparison with those attained by a comparative product.

Discussion about data in Table 4J

With respect to the corrosion resistance, either of the treatment with treating solution A (Nos. 1 to 23) and the treatment with treating solution B (Nos. 24 to 34) exhibited a corrosion resistance much higher than that in the case where no polymer was added (Nos. 35 and 36). When a polymer other than that of the present invention was added (Nos. 37 to 42 and 43 to 45), the corrosion resistance was only equal to (Nos. 37, 39 to 42, and 43 to 45) or lower than that in the case where no polymer was added. It is apparent from the above results that the product of the present invention exhibits a remarkable effect of improving the corrosion resistance.

With respect to adhesion to paint, the products of the present invention (Nos. 1 to 34) exhibited higher adhesion to paint than that of the comparative products (Nos. 35 to 45). Further, similar results were attained in the Erichsen test which had been conducted under more severe conditions. It is apparent from the above results that the products of the present invention enables a remarkable improvement in the adhesion of a chemical conversion coating to paint.

Discussion about data in Table 4K

With respect to the corrosion resistance, the highest corrosion resistance could be attained by the treatment with any of treating solutions A and B (product Nos. 1 and 2 and 4 to 21) except for product No. 3 which exhibited slightly lowered corrosion resistance.

On the other hand, all of the comparative products (Nos. 22 to 26) which had been treated with treating solutions A and B exhibited performance remarkably inferior to that of the products of present invention.

With respect to the adhesion to paint, all of the products of the present invention (Nos. 1 to 21) exhibited the highest adhesion to paint, except for products Nos. 3 and 19 which exhibited an adhesion of rank B in the Erichsen extrusion test. On the other hand, with respect to the comparative products, the results of both the crosscut test and Erichsen extrusion test were remarkably inferior to those attained by the products of the present invention when no polymer was added (product Nos. 22 and 23). When a polymer other than that of the present invention was added (products Nos. 24 to 26), the results of the Erichsen test were remarkably inferior to those attained by the products of the present invention.

Discussion about data in Table 4L

With respect to the corrosion resistance, the highest corrosion resistance could be attained by treatment with either of treating solutions A and B (Nos. 1 to 5 and 7 to 21) except for product No. 6 which exhibited slightly lowered corrosion resistance. On the other hand, the comparative products (Nos. 22 to 26) which had been treated with treating solutions A and B exhibited performance remarkably inferior to that of the products of the present invention.

With respect to adhesion to paint, the products of the present invention (Nos. 1 to 21) exhibited excellent adhesion to paint in the crosscut test as well as in the Erichsen test. On the other hand, with respect to the comparative products, the results of both the crosscut test and Erichsen extrusion test were remarkably inferior to those attained by the products of the present invention when no polymer was added (Nos. 22 and 23).

It is apparent from the above results that the coatings treated with the products of the present invention are excellent in corrosion resistance as well as in adhesion to a paint.

TABLE 4J

| | | treating conditions | | | | corrosion | adhesion to paint | |
|---|---|---|---|---|---|---|---|---|
| | | treating | added polymer | | coating | resistance | I | II |
| | No. | solution | kind | amount (g/l) | method | I | (crosscut test) | (Erichsen extrusion test) |
| product of | 1 | A | 1 | 1 | a | >360 hr | 100/100 | B |

TABLE 4J-continued

| | No. | treating conditions: treating solution | added polymer: kind | added polymer: amount (g/l) | coating method | corrosion resistance I | adhesion to paint I (crosscut test) | adhesion to paint II (Erichsen extrusion test) |
|---|---|---|---|---|---|---|---|---|
| the present invention | 2 | A | 2 | 1 | a | " | " | B |
| | 3 | A | 3 | 2 | a | " | " | B |
| | 4 | A | 4 | 1 | a | " | " | B |
| | 5 | A | 5 | 5 | a | " | " | B |
| | 6 | A | 6 | 2 | a | " | " | B |
| | 7 | A | 7 | 2 | a | " | " | A |
| | 8 | A | 8 | 0.5 | a | " | " | B |
| | 9 | A | 9 | 3 | a | " | " | B |
| | 10 | A | 10 | 2 | a | " | " | B |
| | 11 | A | 11 | 2 | a | " | " | B |
| | 12 | A | 12 | 2 | a | " | " | B |
| | 13 | A | 13 | 1 | a | " | " | B |
| | 14 | A | 14 | 30 | a | " | " | B |
| | 15 | A | 15 | 5 | a | " | " | B |
| | 16 | A | 16 | 1 | a | >360 hr | 100/100 | B |
| | 17 | A | 17 | 1 | a | " | " | B |
| | 18 | A | 18 | 1 | a | " | " | B |
| | 19 | A | 19 | 1 | a | " | " | B |
| | 20 | A | 20 | 2 | a | " | " | B |
| | 21 | A | 21 | 2 | a | " | " | B |
| | 22 | A | 22 | 2 | a | " | " | B |
| | 23 | A | 23 | 2 | a | " | " | B |
| | 24 | B | 1 | 1 | b | >1500 hr | " | B |
| | 25 | B | 5 | 1 | b | " | " | B |
| | 26 | B | 7 | 1 | b | " | " | B |
| | 27 | B | 8 | 1 | b | " | " | B |
| | 28 | B | 9 | 1 | b | " | " | B |
| | 29 | B | 10 | 1 | b | " | " | B |
| | 30 | B | 11 | 2 | b | " | " | B |
| | 31 | B | 12 | 2 | b | >1500 hr | 100/100 | B |
| | 32 | B | 17 | 3 | b | " | " | B |
| | 33 | B | 21 | 1 | b | " | " | B |
| | 34 | B | 23 | 1 | b | " | " | B |
| comparative product | 35 | A | — | — | a | 240 hr | 60/100 | D |
| | 36 | B | — | — | b | 1000 hr | 70/100 | D |
| | 37 | A | R-1 | 1 | a | 240 hr | 50/100 | C |
| | 38 | A | R-2 | 1 | a | 216 hr | 70/100 | C |
| | 39 | A | R-3 | 1 | a | 240 hr | 80/100 | C |
| | 40 | A | R-4 | 2 | a | 240 hr | 60/100 | C |
| | 41 | A | R-5 | 2 | a | 240 hr | 60/100 | C |
| | 42 | A | R-6 | 2 | a | 240 hr | 60/100 | C |
| | 43 | B | R-2 | 1 | b | 1000 hr | 50/100 | D |
| | 44 | B | R-5 | 1 | b | 1000 hr | 60/100 | D |
| | 45 | B | R-6 | 2 | b | 1000 hr | 70/100 | D |

TABLE 4K

| | No. | treating conditions: treating solution | added polymer: kind | added polymer: amount (g/l) | coating method | corrosion resistance I | adhesion to paint I (crosscut test) | adhesion to paint II (Erichsen extrusion test) |
|---|---|---|---|---|---|---|---|---|
| product of the present invention | 1 | A | 1 | 2 | a | >360 hr | 100/100 | A |
| | 2 | A | 2 | 2 | a | " | " | A |
| | 3 | A | 3 | 0.4 | a | 336 hr | " | B |
| | 4 | A | 4 | 1 | a | >360 hr | " | A |
| | 5 | A | 5 | 1 | a | " | " | A |
| | 6 | A | 6 | 2 | a | " | " | A |
| | 7 | A | 7 | 5 | a | " | " | A |
| | 8 | A | 8 | 2 | a | " | " | A |
| | 9 | A | 9 | 1 | a | " | " | A |
| | 10 | A | 10 | 1 | a | " | " | A |
| | 11 | A | 11 | 2 | a | " | " | A |
| | 12 | A | 12 | 20 | a | " | " | A |
| | 13 | A | 13 | 1 | a | " | " | A |
| | 14 | A | 14 | 2 | a | " | " | A |
| | 15 | B | 2 | 2 | b | >1500 hr | " | A |
| | 16 | B | 4 | 0.4 | b | >1500 hr | 100/100 | A |
| | 17 | B | 5 | 1 | b | " | " | A |
| | 18 | B | 7 | 1 | b | " | " | A |
| | 19 | B | 8 | 20 | b | " | " | B |
| | 20 | B | 11 | 2 | b | " | " | A |
| | 21 | B | 14 | 2 | b | " | " | A |
| comparative product | 22 | A | — | — | a | 240 hr | 60/100 | D |
| | 23 | B | — | — | b | 1000 hr | 70/100 | D |
| | 24 | A | R-1 | 1 | a | 288 hr | 100/100 | C |
| | 25 | A | R-2 | 1 | a | 288 hr | 100/100 | C |

TABLE 4K-continued

| | | treating conditions | | | | corrosion | adhesion to paint | |
|---|---|---|---|---|---|---|---|---|
| | | treating | added polymer | | coating | resistance | I | II |
| | No. | solution | kind | amount (g/l) | method | I | (crosscut test) | (Erichsen extrusion test) |
| | 26 | B | R-1 | 1 | b | 1200 hr | 100/100 | C |

TABLE 4L

| | | treating conditions | | | | corrosion | adhesion to paint | |
|---|---|---|---|---|---|---|---|---|
| | | treating | added polymer | | coating | resistance | I | II |
| | No. | solution | kind | amount (g/l) | method | I | (crosscut test) | (Erichsen extrusion test) |
| product of the present invention | 1 | A | 1 | 1 | a | >360 hr | 100/100 | B |
| | 2 | A | 2 | 1 | a | " | " | B |
| | 3 | A | 3 | 2 | a | " | " | B |
| | 4 | A | 4 | 5 | a | " | " | B |
| | 5 | A | 5 | 1 | a | " | " | B |
| | 6 | A | 6 | 0.5 | a | 312 hr | " | B |
| | 7 | A | 7 | 2 | a | >360 hr | " | B |
| | 8 | A | 8 | 2 | a | " | " | B |
| | 9 | A | 9 | 10 | a | " | " | B |
| | 10 | A | 10 | 1 | a | " | " | B |
| | 11 | A | 11 | 1 | a | " | " | B |
| | 12 | A | 12 | 30 | a | " | " | B |
| | 13 | A | 13 | 2 | a | " | " | B |
| | 14 | A | 14 | 2 | a | " | " | B |
| | 15 | B | 1 | 1 | b | >1500 hr | " | B |
| | 16 | B | 2 | 1 | b | >1500 hr | 100/100 | B |
| | 17 | B | 4 | 0.5 | b | " | " | B |
| | 18 | B | 5 | 2 | b | " | " | B |
| | 19 | B | 6 | 2 | b | " | " | B |
| | 20 | B | 10 | 20 | b | " | " | B |
| | 21 | B | 13 | 2 | b | " | " | B |
| comparative product | 22 | A | — | — | a | 240 hr | 60/100 | D |
| | 23 | B | — | — | b | 1000 hr | 70/100 | D |
| | 24 | A | R-1 | 1 | a | 288 hr | 100/100 | C |
| | 25 | A | R-2 | 1 | a | 288 hr | 100/100 | C |
| | 26 | B | R-1 | 1 | b | 1200 hr | 100/100 | C |

EXAMPLE 2

A hot galvanized sheet was degreased with acetone and then treated with a solution prepared by adding a water-soluble or self-water-dispersible polymer shown in Table 1J, 1K, 1L to treating solution C or D shown in Table 2. Coating of the treated sheet was conducted by the method (c) or (d) shown in Table 3. Results are shown in Table 5J, 5K, 5L.

COMPARATIVE EXAMPLE 2

Samples were treated in the same manner as that of Example 2, except that the treatment was conducted by making use of treating solution C or D shown in Table 2 after addition of a polymer other than that of the present invention or without addition of any polymer. Results are given in Table 5J, 5K, 5L and show the corrosion resistance and adhesion to paint of a coating formed by surface treatment of a galvanized steel sheet with a water-soluble or self-water-dispersible organic polymer according to the present invention in comparison with those attained by comparative products.

Discussion about data in Table 5J

With respect to corrosion resistance, either treatment with treating solution C (Nos. 1 to 7) or treatment with treating solution D (Nos. 8 to 15) exhibited corrosion resistance much higher than that of the comparative products (Nos. 16 to 20). Among the comparative products, Nos. 18 and 19 unfavorably exhibited a lowering in the corrosion resistance through the addition of the polymer. It is apparent from the above results that the product of the present invention exhibits a remarkable effect of improving the corrosion resistance of a galvanized steel sheet as well.

With respect to the adhesion to paint, no difference in the results of the crosscut test was observed between the products of the present invention and the comparative products. However, in the Erichsen extrusion test which had been conducted under more severe conditions, all the products of the present invention exhibited the results of the highest rank A except for the products containing a slightly smaller amount of the polymer added thereto (No. 1) or a slightly larger amount of the polymer added thereto (No. 13) which exhibited corrosion resistance of rank B, while comparative products (Nos. 16 to 20) exhibited remarkably inferior results. It is apparent from the above results that the products of the present invention exhibits a remarkable effect with respect to the adhesion to paint as well.

Discussion about data in Table 5K

With respect to the corrosion resistance, all of the products of the present invention exhibited the highest corrosion resistance of rank A except for the products containing a slightly smaller amount of the polymer (No. 3) or a slightly larger amount of the polymer (No. 9) which exhibited a corrosion resistance of rank B. On the other hand, the comparative products (Nos. 14 and 15) exhibited only low corrosion resistance.

With respect to adhesion to paint, no difference in the results of the crosscut test was observed between the products of the present invention and the comparative products. However, in the Erichsen extrusion test, which has been conducted under more sever conditions, all of the products of the present invention exhibited the results of the highest rank A, while comparative product Nos. 14 and 15 exhibited the results of low ranks.

Discussion about data in Table 5L

With respect to the corrosion resistance, all of the products of the present invention exhibited the highest corrosion resistance of rank A except for the products containing a slightly smaller amount of the polymer (No. 3) or a slightly larger amount of the polymer (No. 6) which exhibited a corrosion resistance of rank B. On the other hand, the comparative products (Nos. 14 and 15) exhibited only low corrosion resistance.

With respect to adhesion to paint, no difference in the results of the crosscut test was observed between the products of the present invention and the comparative products. However, in the Erichsen extrusion test, which has been conducted under more severe conditions, all of the products of the present invention exhibited the highest corrosion resistance of rank A except for the product containing a slightly smaller amount of the polymer added thereto (No. 3) which exhibited corrosion resistance of rank B, which substantiates that the products of the present invention have a remarkable effect with respect to the adhesion to paint as well.

TABLE 5J

| | | treating conditions | | | | corrosion | adhesion to paint | |
|---|---|---|---|---|---|---|---|---|
| | | treating | added polymer | | coating | resistance | I | II |
| | No. | solution | kind | amount (g/l) | method | II | (crosscut test) | (Erichsen extrusion test) |
| product of the present invention | 1 | C | 2 | 0.4 | c | B | 100/100 | B |
| | 2 | C | 4 | 1 | c | A | " | A |
| | 3 | C | 7 | 1 | c | A | " | A |
| | 4 | C | 11 | 2 | c | A | " | A |
| | 5 | C | 15 | 2 | c | A | " | A |
| | 6 | C | 16 | 5 | c | A | " | A |
| | 7 | C | 22 | 1 | c | A | " | A |
| | 8 | D | 4 | 1 | d | A | " | A |
| | 9 | D | 6 | 0.4 | d | B | " | A |
| | 10 | D | 9 | 4 | d | A | " | A |
| | 11 | D | 12 | 1 | d | A | " | A |
| | 12 | D | 14 | 2 | d | A | " | A |
| | 13 | D | 18 | 10 | d | A | " | B |
| | 14 | D | 19 | 1 | d | A | " | A |
| | 15 | D | 23 | 1 | d | A | " | A |
| comparative product | 16 | C | — | — | c | D | 100/100 | C |
| | 17 | D | — | — | d | C | " | D |
| | 18 | C | R-2 | 1 | c | E | " | C |
| | 19 | C | R-5 | 2 | c | E | " | C |
| | 20 | D | R-6 | 1 | d | C | " | D |

TABLE 5K

| | | treating conditions | | | | corrosion | adhesion to paint | |
|---|---|---|---|---|---|---|---|---|
| | | treating | added polymer | | coating | resistance | I | II |
| | No. | solution | kind | amount (g/l) | method | II | (crosscut test) | (Erichsen extrusion test) |
| product of the present invention | 1 | C | 2 | 1 | c | A | 100/100 | A |
| | 2 | C | 5 | 1 | c | A | " | A |
| | 3 | C | 7 | 0.4 | c | B | " | A |
| | 4 | C | 8 | 1 | c | A | " | A |
| | 5 | C | 10 | 2 | c | A | " | A |
| | 6 | C | 11 | 2 | c | A | " | A |
| | 7 | C | 13 | 2 | c | A | " | A |
| | 8 | D | 3 | 2 | d | A | " | A |
| | 9 | D | 4 | 30 | d | B | " | A |
| | 10 | D | 6 | 1 | d | A | " | A |
| | 11 | D | 9 | 1 | d | A | " | A |
| | 12 | D | 11 | 2 | d | A | " | A |
| | 13 | D | 14 | 2 | d | A | " | A |
| comparative product | 14 | C | — | — | c | D | " | C |
| | 15 | D | — | — | d | C | " | D |

TABLE 5L

| | | treating conditions | | | | corrosion | adhesion to paint | |
|---|---|---|---|---|---|---|---|---|
| | | treating | added polymer | | coating | resistance | I | II |
| | No. | solution | kind | amount (g/l) | method | II | (crosscut test) | (Erichsen extrusion test) |
| product of the present invention | 1 | C | 1 | 1 | c | A | 100/100 | A |
| | 2 | C | 3 | 1 | c | A | " | A |
| | 3 | C | 4 | 0.4 | c | B | " | B |
| | 4 | C | 8 | 2 | c | A | " | A |
| | 5 | C | 9 | 2 | c | A | " | A |
| | 6 | C | 11 | 20 | c | B | " | A |
| | 7 | C | 12 | 1 | c | A | " | A |
| | 8 | D | 2 | 1 | d | A | " | A |
| | 9 | D | 5 | 1 | d | A | " | A |
| | 10 | D | 7 | 2 | d | A | " | A |
| | 11 | D | 9 | 2 | d | A | " | A |
| | 12 | D | 10 | 5 | d | A | " | A |

TABLE 5L-continued

| | | treating conditions | | | | corrosion | adhesion to paint | |
|---|---|---|---|---|---|---|---|---|
| | | treating | added polymer | | coating | resistance | I | II |
| | No. | solution | kind | amount (g/l) | method | II | (crosscut test) | (Erichsen extrusion test) |
| | 13 | D | 14 | 2 | d | A | " | A |
| comparative | 14 | C | — | — | c | D | " | C |
| product | 15 | D | — | — | d | C | " | D |

We claim:

1. A method for treating a surface of a metal article comprising a step of contacting the surface of the metal article with an aqueous solution containing at least one metal ion and an additive of organic polymer (L); wherein polymer (L) is a hydroxystyrene having formula (L):

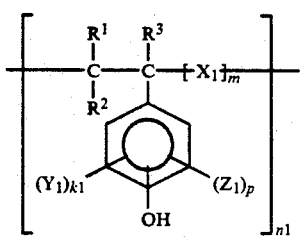

(L)

wherein m>0 and n1≦3 and each is a number necessary for said organic polymer represented by the general formula (L) to have a weight average molecular weight up to 1,000,000;

k1 is a number from 0 to 2;

p is a number from 0 to 2;

$R^1$ to $R^3$ is each H or an alkyl group having 1 to 5 carbon atoms;

$X_1$ is a polymerizable vinyl monomer;

$Y_1$ and $Z_1$, which may be the same or different, are each selected from among

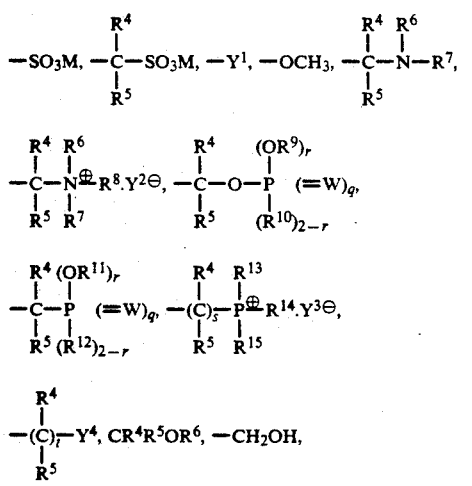

alkyl groups each having 1 to 18 carbon atoms and aryl groups, wherein M is H, an alkali, an alkali earth metal, or an organic cation of an amine;

$Y^1$ and $Y^4$ is each a halogen;

$Y^{2-}$ and $Y^{3-}$ is each a counter ion;

W is S or O;

$R^4$, $R^5$ and $R^8$, which may be the same or different, is each a straight-chain or branched alkyl group, an alkyl group derivative such as a hydroxyalkyl group, an aromatic group, or H;

$R^6$ and $R^7$, which may be the same or different, is each a straight-chain or branched alkyl group, an alkyl groyp derivative such as a hydroxyalkyl group, an aromatic group, H, or together form a heterocyclic group with the nitrogen atom;

$R^9$ to $R^{15}$, which may be the same or different, are each a straight-chain or branched alkyl group, an alkyl group derivative, an aromatic group, or H;

q, s and t is each 0 or 1; and r is 0, 1 or 2.

2. A method as claimed in claim 1, in which the metal ion is selected from the group consisting of Ti, Zr, Hf, Ni, Co, Cr, Mn, selected from the group consisting of Ti, Zr, Hf, Ni, Co, Cr, Mn, Al, Ca and Mg.

3. A method as claimed in claim 1, in which said metal ion is a zinc ion.

4. A metal article treated by the method of claim 1.

5. An aqueous solution containing at least one metal ion and an additive of organic polymer (L); wherein polymer L is a hydroxystyrene having formula (L):

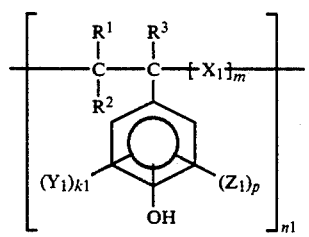

(L)

wherein m>0 and n1≧3 and each is a number necessary for said organic polymer represented by the general formula (L) to have a weight average molecular weight up to 1,000,000;

k1 is a number from 0 to 2;

p is a number from 0 to 2;

$R^1$ to $R^3$ is each H or an alkyl group having 1 to 5 carbon atoms;

$X_1$ is a polymerizable vinyl monomer;

$Y_1$ and $Z_1$, which may be the same or different, are each selected from among

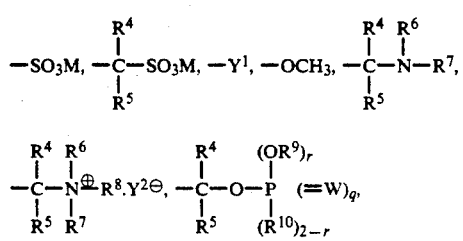

-continued

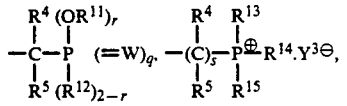

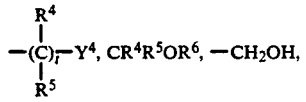

alkyl groups each having 1 to 18 carbon atoms and aryl groups, wherein M is H, an alkali, an alkali earth metal, or an organic cation of an amine;

$Y^1$ and $Y^4$ is each a halogen;

$Y^{2-}$ and $Y^{3-}$ is each a counter ion;

W is S or O;

$R^4$, $R^5$ and $R^8$, which may be the same or different, is each a straight-chain or branched alkyl group, an alkyl group derivative such as a hydroxyalkyl group, an aromatic group, or H;

$R^6$ and $R^7$, which may be the same or differnent, is each a straight-chain or branched alkyl group, an alkyl group derivative such as a hydroxyalkyl group, an aromatic group, H, or together form a heterocyclic group with the nitrogen atom;

$R^9$ to $R^{15}$, which may be the same or different, is each a straight-chain or branched alkyl group, an alkyl group derivative, an aromatic group, or H;

q, s and t is each as 0 or 1; and r is 0, 1 or 2.

6. An aqueous solution according to claim 5, in which said metal ion is a zinc ion.

* * * * *

UNITED STATES PATENT AND TRADEMARK OFFICE

CERTIFICATE OF CORRECTION

PATENT NO. : 5 246 507

DATED : September 21, 1993

INVENTOR(S) : Kenji KODAMA et al

It is certified that error appears in the above-identified patent and that said Letters Patent is hereby corrected as shown below:

Column 37, line 29; change "n1≤3" to ---n1≥3---.

Column 38, line 17; change "groyp" to ---group---.

line 27; delete "selected from the group consisting of".

line 28; delete "Ti, Zr, Hf, Ni, Co, Cr, Mn,".

Column 40, line 6; change "differnent" to ---different---.

Signed and Sealed this

Fifth Day of April, 1994

Bruce Lehman

*Attest:*

BRUCE LEHMAN

*Attesting Officer*

*Commissioner of Patents and Trademarks*